US010041337B2

(12) United States Patent
Walker et al.

(10) Patent No.: US 10,041,337 B2
(45) Date of Patent: Aug. 7, 2018

(54) HYBRID BIG HOLE LINER

(71) Applicant: HALLIBURTON ENERGY SERVICES, INC., Houston, TX (US)

(72) Inventors: Jerry Leroy Walker, Azle, TX (US); Jason Paul Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 300 days.

(21) Appl. No.: 14/891,190

(22) PCT Filed: Jul. 19, 2013

(86) PCT No.: PCT/US2013/051243

§ 371 (c)(1),
(2) Date: Nov. 13, 2015

(87) PCT Pub. No.: WO2015/009313

PCT Pub. Date: Jan. 22, 2015

(65) Prior Publication Data

US 2016/0090826 A1 Mar. 31, 2016

(51) Int. Cl.
*E21B 43/117* (2006.01)
*F42B 1/032* (2006.01)

(52) U.S. Cl.
CPC ..... *E21B 43/117* (2013.01); *F42B 1/032* (2013.01)

(58) Field of Classification Search
CPC ..... E21B 43/117; E21B 43/11; E21B 43/116; F42B 1/032; F42B 1/028; F42B 1/02; F42B 1/00
See application file for complete search history.

(56) References Cited

U.S. PATENT DOCUMENTS

| | | | | |
|---|---|---|---|---|
| 2,494,256 | A | 1/1950 | Muskat et al. | |
| 2,843,041 | A | 7/1958 | Stewart | |
| 4,498,367 | A | 2/1985 | Skolnick et al. | |
| 5,098,487 | A | 3/1992 | Brauer et al. | |
| 5,175,391 | A | 12/1992 | Walters et al. | |
| 6,021,714 | A | 2/2000 | Grove et al. | |
| 6,840,178 | B2 | 1/2005 | Collins et al. | |
| 7,393,423 | B2 | 7/2008 | Liu et al. | |
| 7,712,416 | B2 | 5/2010 | Pratt et al. | |
| 7,913,761 | B2 * | 3/2011 | Pratt | E21B 43/26 166/297 |
| 7,987,911 | B2 | 8/2011 | Rhodes et al. | |

(Continued)

FOREIGN PATENT DOCUMENTS

WO 2006054081 5/2006

OTHER PUBLICATIONS

International Patent Application No. PCT/US2013/051243 , International Search Report and Written Opinion, dated Apr. 15, 2014, 12 pages.

(Continued)

*Primary Examiner* — Wei Wang
(74) *Attorney, Agent, or Firm* — Kilpatrick Townsend & Stockton LLP

(57) ABSTRACT

A shaped-charge liner for a shaped-charge assembly is provided. The shaped-charge assembly includes a housing, a single liner, and explosive material between the housing and the liner. The single liner includes an apex portion constructed from a first material and a skirt portion made from a second material that is different than the first material.

14 Claims, 5 Drawing Sheets

(56) References Cited

U.S. PATENT DOCUMENTS

| | | | | |
|---|---|---|---|---|
| 8,156,871 | B2 | 4/2012 | Behrmann et al. | |
| 8,381,652 | B2 | 2/2013 | Glenn et al. | |
| 2001/0052303 | A1 | 12/2001 | Mayseless et al. | |
| 2002/0017214 | A1 | 2/2002 | Jacoby et al. | |
| 2002/0078850 | A1* | 6/2002 | Renfro ..... | F42B 1/028 102/476 |
| 2003/0183113 | A1 | 10/2003 | Barlow et al. | |
| 2005/0115448 | A1 | 6/2005 | Pratt et al. | |
| 2007/0056462 | A1 | 3/2007 | Bates et al. | |
| 2009/0235836 | A1 | 9/2009 | Pratt et al. | |
| 2011/0088889 | A1 | 4/2011 | Grove et al. | |
| 2011/0155013 | A1 | 6/2011 | Boyer et al. | |
| 2011/0219978 | A1 | 9/2011 | Glenn | |
| 2012/0234194 | A1 | 9/2012 | Glenn et al. | |

OTHER PUBLICATIONS

United Kingdom Patent Application No. GB1519478.0 , Examination Report, dated Feb. 29, 2016, 1 page.

* cited by examiner

HYBRID BIG HOLE LINER

CROSS-REFERENCE TO RELATED APPLICATIONS

This is a U.S. national phase under 35 U.S.C. § 371 of International Patent Application No. PCT/US2013/051243, titled "Hybrid Big Hole Liner" and filed Jul. 19, 2013, the entirety of which is incorporated herein by reference.

TECHNICAL FIELD

The present disclosure relates generally to a liner for a perforator to be located in a wellbore and, more particularly (although not necessarily exclusively), to a liner made from two different materials.

BACKGROUND

Hydrocarbons can be produced from wellbores drilled from the surface through a variety of producing and non-producing formations. A wellbore may be substantially vertical or may be offset. A variety of servicing operations can be performed on a wellbore after it has been initially drilled. For example, a lateral junction can be set in the wellbore at the intersection of two lateral wellbores or at the intersection of a lateral wellbore with the main wellbore. A casing string can be set and cemented in the wellbore. A liner can be hung in the casing string. The casing string can be perforated by firing a perforation gun or perforation tool.

Perforation tools can include explosive charges that are detonated to fire for perforating a casing and create perforations or tunnels into a subterranean formation that is proximate to the wellbore. Creating a large perforation in casing without introducing significant debris is desirable.

DETAILED DESCRIPTION

Certain aspects and features relate to a shaped-charge liner for a well perforator. The liner may be parabolic shaped and it may be a single liner made from different materials. The liner can include an apex portion that is made from a first material and can include a skirt portion that is made from a second material. The apex portion that is made from the first material can provide desired performance in the formation of a jet for creating a large perforation. The skirt layer that is made from the second material can result in reduced debris subsequent to perforation. In some aspects, the first material includes copper and the second material includes brass.

The first material from which the apex portion of the liner is made may include other or additional materials than copper. Examples of suitable materials for the first material include uranium, lead, steel, gold, and silver. Any material having a density greater than 7.5 grams per cubic centimeter may be suitable to include in the first material.

The second material from which the skirt portion of the liner is made may include other or additional materials than brass. Examples of suitable materials for the second material include aluminum, zinc, and lead. Any material that can break up into small fragments in response to a force may be suitable to include in the second material.

In some aspects, the apex portion and the skirt portion of the liner are not connected to each other. The apex portion and the skirt portion, however, may contact each other and couple to each other, such as by interference, within a shaped-charge assembly. In other aspects, the apex portion and the skirt portion are connected to each other, such as by being soldered together using a suitable solder material (e.g., silver).

The first material can be useful in creating large perforation holes and the second material can break up into relatively small fragments. Using a shaped-charge liner according to certain aspects may result in creating a perforation hole with an increased size in the well casing without introducing a significant amount of debris. Having a perforation hole with an increase size can add flow area per linear foot of perforations and reduce the velocity by which hydrocarbons enter the wellbore, and control sanding problems when producing from unconsolidated formations.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
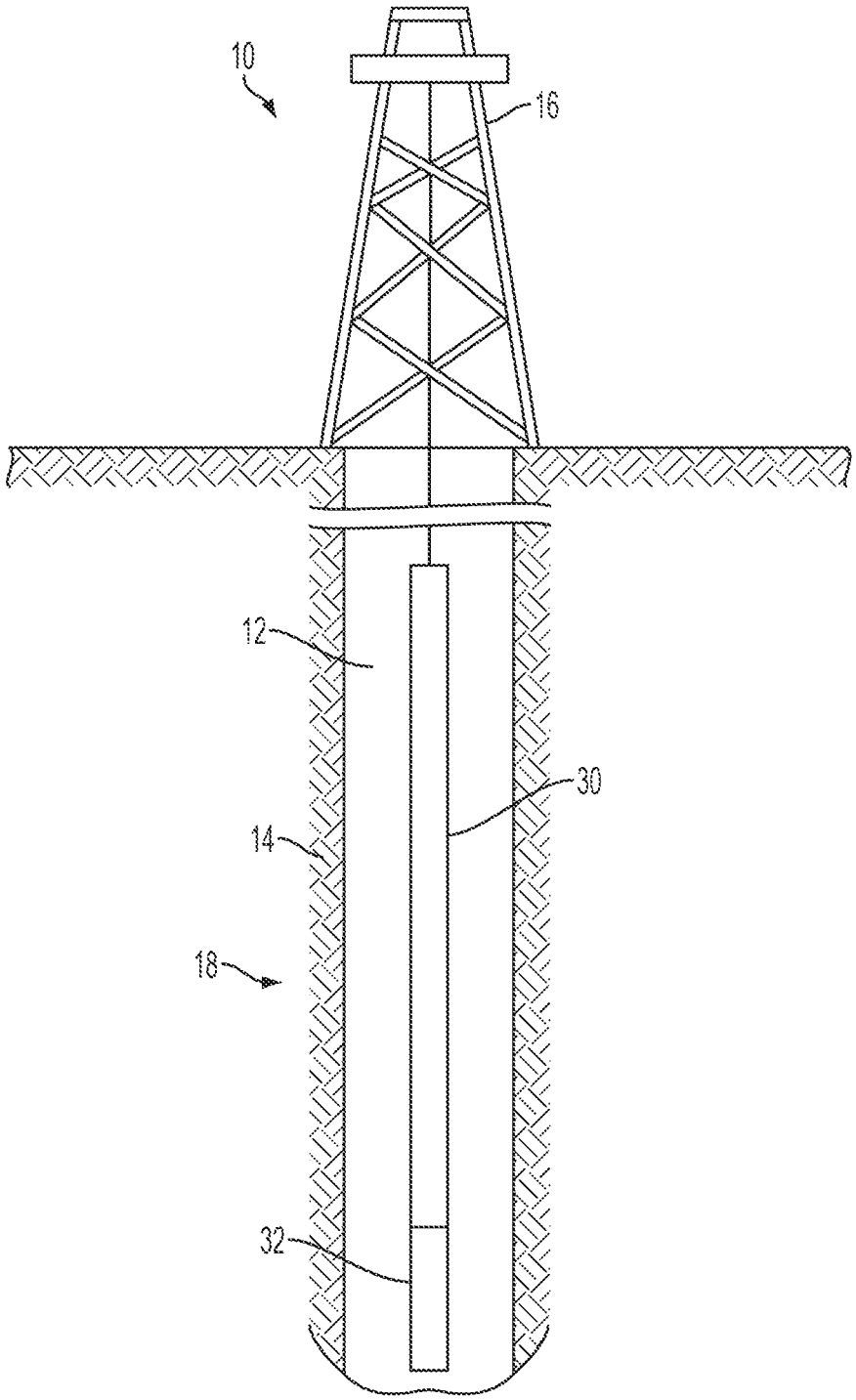
FIG. 1 is a schematic view of a wellbore that includes a perforation tool having a liner constructed from different materials according to one aspect.

FIG. 1 depicts an example of a wellbore servicing system 10 that includes a shaped-charge liner made from different materials. The system 10 includes a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in other examples the wellbore 12 may be deviated, horizontal, or curved over at least some portions of the wellbore 12. The wellbore 12 may be cased, open hole, contain tubing, and may include a hole in the ground having a variety of shapes or geometries.

The servicing rig 16 may be a drilling rig, a completion rig, a workover rig, a servicing rig, or other mast structure, or a combination of these. The servicing rig 16 can support a workstring 18 in the wellbore 12, but in other examples a different structure may support the workstring 18. For example, an injector head of a coiled tubing rigup can support the workstring 18. In some aspects, the servicing rig 16 may include a derrick with a rig floor through which the workstring 18 extends downward from the servicing rig 16 into the wellbore 12. Piers extending downwards to a seabed in some implementations may support the servicing rig 16. Alternatively, the servicing rig 16 may be supported by columns sitting on hulls or pontoons (or both) that are ballasted below the water surface, which may be referred to as a semi-submersible platform or rig. In an off-shore location, a casing may extend from the servicing rig 16 to exclude sea water and contain drilling fluid returns. Other mechanical mechanisms that are not shown may control the run-in and withdrawal of the workstring 18 in the wellbore 12. Examples of these other mechanical mechanisms include a draw works coupled to a hoisting apparatus, a slickline unit or a wireline unit including a winching apparatus, another servicing vehicle, and a coiled tubing unit.

The workstring 18 may include a conveyance 30, a perforation tool 32, and other tools or subassemblies (not shown) located above or below the perforation tool 32. The conveyance 30 may include any of a slickline, a coiled tubing, a string of jointed pipes, a wireline, and other conveyances for the perforation tool 32. The perforation tool 32 can include one or more explosive charges that may be triggered to explode for perforating a casing (if present), perforating a wall of the wellbore 12, and forming perforations or tunnels out into the formation 14. The perforating may promote recovering hydrocarbons from the formation 14 for production at the surface, storing hydrocarbons flowed into the formation 14, or disposing of carbon dioxide in the formation 14.

Figure 2:
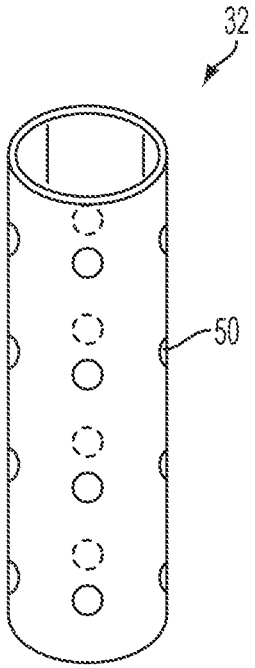
FIG. 2 is a perspective view of an example of a perforation tool according to one aspect.

FIG. 2 depicts by perspective view an example of the perforation tool 32 that includes a shaped-charge liner made from different materials. The perforation tool 32 includes one or more explosive shaped-charge assemblies 50. The perforation tool 32 may include a tool body (not shown) that contains the shaped-charge assemblies 50 and protects and seals them from the downhole environment prior to perforation. A surface of the tool body may be bored or countersunk, or both, proximate to the shaped-charge assemblies 50 to promote ease of perforation of the tool body by detonation of the shaped-charge assemblies 50. The tool body may be constructed out of various metal materials. The tool body may be constructed of one or more kinds of steel, including stainless steel, chromium steel, and other steels. Alternatively, the tool body may be constructed of other non-steel metals or metal alloys.

The shaped-charge assemblies 50 may be disposed in a first plane perpendicular to the axis of the tool body, and additional planes or rows of additional shaped-charge assemblies 50 may be positioned above and below the first plane. In one example, four shaped-charge assemblies 50 may be located in the same plane perpendicular to the axis of the tool body, and 90 degrees apart. In another example, three shaped-charge assemblies 50 may be located in the same plane perpendicular to the axis of the tool body, and 120 degrees apart. In other examples, however, more shaped-charge assemblies may be located in the same plane perpendicular to the axis of the tool body. The direction of the shaped-charge assemblies 50 may be offset by about 45 degrees between the first plane and a second plane, to promote more densely arranging the shaped-charge assemblies 50 within the tool body. The direction of the shaped-charge assemblies 50 may be offset by about 60 degrees between the first plane and a second plane, to promote more densely arranging the shaped-charge assemblies 50 within the tool body.

A frame structure (not shown) may be included in the tool body and can retain the shaped-charge assemblies 50 in planes, oriented in a preferred direction, and with appropriate angular relationships between rows. In some aspects, a detonator cord couples to each of the shaped-charge assemblies 50 to detonate the shaped-charge assemblies 50. When the perforation tool 32 includes multiple planes or rows of shaped-charge assemblies 50, the detonator cord may be disposed on the center axis of the tool body. The detonator cord may couple to a detonator apparatus that is triggered by an electrical signal or a mechanical impulse, or by another trigger signal. When the detonator activates, a detonation can propagate through the detonation cord to each of the shaped-charge assemblies 50 to detonate each of the shaped-charge assemblies 50 substantially at the same time.

Figure 3:
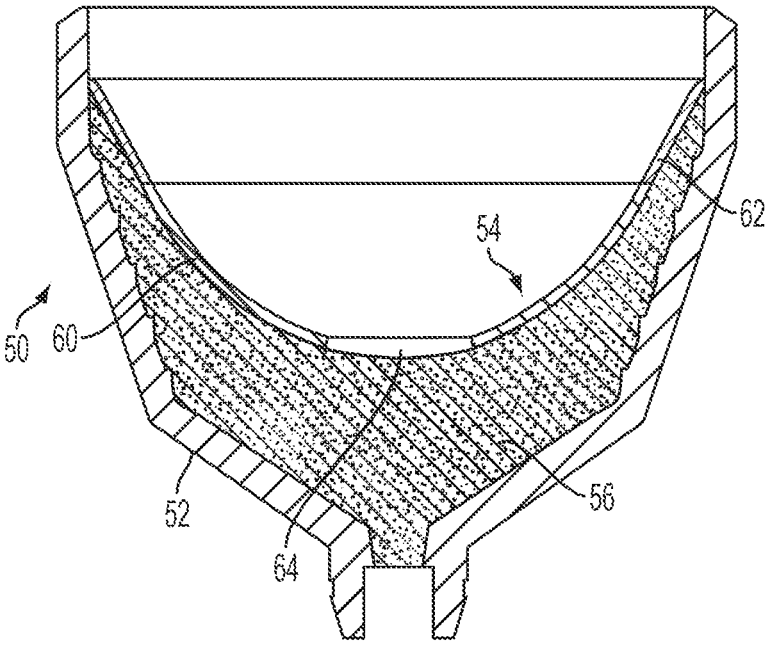
FIG. 3 is a cross-sectional view of a shaped-charge assembly for a perforation tool according to one aspect.

FIG. 3 depicts by cross section an example of a shaped-charge assembly 50. The shaped-charge assembly includes a housing 52, a liner 54, and explosive material 56 located between the liner 54 and the housing 52. The liner 54 may be a parabolic-shaped liner. In some aspects, the shaped-charge assembly 50 includes the single liner 54. The liner 54 includes an apex portion 60 and a skirt portion 62. The apex portion 60 can have an opening 64. The size of the opening 64 may vary, for example from zero inches (i.e., no opening) to one inch. In some aspects, the skirt portion 62 is coupled to the housing 52. The apex portion 60 and the skirt portion 62 may not overlap and may not be connected to each other.

Figure 4:
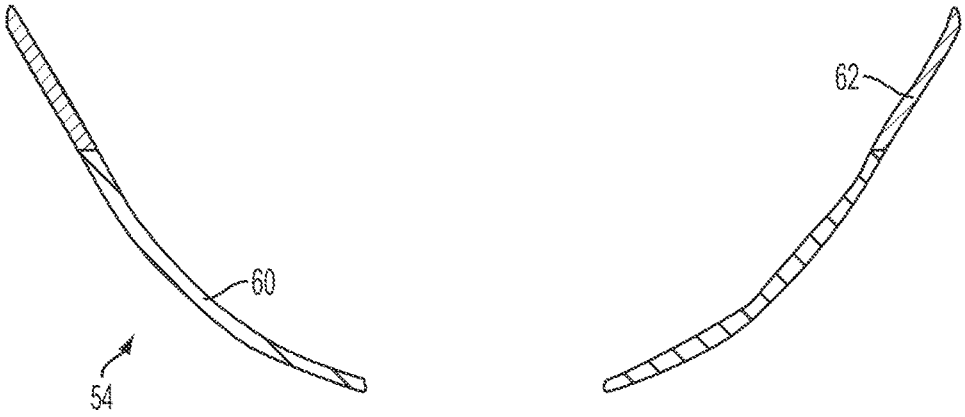
FIG. 4 is a cross-sectional view a shaped-charge liner according to one aspect.

FIG. 4 depicts by cross section an example of the liner 54. The apex portion 60 and the skirt portion 62 may have the same thickness or they may have different thickness. An example of an average thickness for each of the apex portion 60 and skirt portion 62 is 0.032 inches in a range of 0.017 inches to 0.047 inches.

The apex portion 60 and the skirt portion 62 of the liner can be constructed from different materials. The apex portion 60 may be constructed from a material that facilitates large perforation hole creation and the skirt portion 62 may be constructed from a material that results in a reduction in debris during or after perforation. For example, the apex portion 60 can be constructed from copper and the skirt portion 62 can be constructed from brass. Examples of other materials from which the apex portion 60 can be constructed include uranium, lead, steel, gold, and silver. Any material having a density greater than 7.5 grams per cubic centimeter may be a suitable material from which to construct the apex portion. Examples of other materials from which the skirt portion 62 can be constructed include aluminum, zinc, and lead. Any material that can break up into small fragments in response to an explosive force may be a suitable material from which to construct the skirt portion 62. In some aspects, each of the apex portion 60 and the skirt portion 62 are constructed from materials that include a certain percentage of brass. For example, the apex portion 60 may include about 10% brass and the skirt portion 62 may include about 80% brass.

Figure 5:
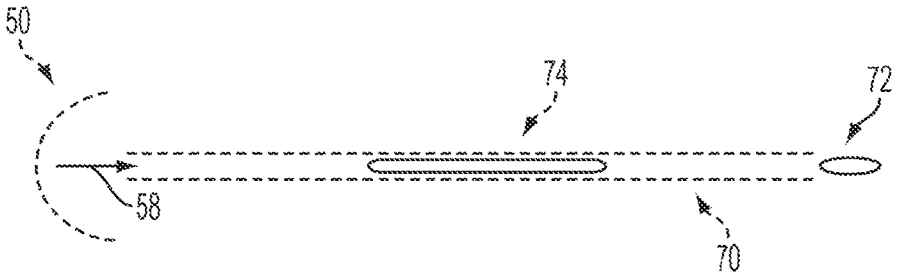
FIG. 5 is a diagram of an explosive jet from a shaped-charge assembly according to one aspect.

FIG. 5 depicts an example of a detonation jet of the shaped-charge assembly 50. When the shaped charge in the shaped-charge assembly 50 is detonated, for example by the propagation of a detonation from the detonator cord to the shaped charge, the energy of the detonation can be concentrated or focused along an explosive focus axis 58, forming a detonation jet 70 indicated by the dotted line. A portion (e.g., the apex portion 60 in FIGS. 3 and 4) of the shaped-charge liner 54 may form a projectile 72 that is accelerated by the energy of detonation and forms the leading edge of the detonation jet 70 as it penetrates into casing. The projectile 72 can include dense material that may penetrate more effectively than less dense material. Another portion (e.g., the skirt portion 62 in FIGS. 3 and 4) of the shaped charge liner 54 may form a slug 74 that moves more slowly and lags behind the projectile 72. The slug 74 may include material that can break up more easily and reduce the amount of debris as a result of the perforation operation.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A shaped-charge assembly, comprising:

a housing;

a single liner including an apex portion constructed from copper to create a large perforation hole and a skirt portion made from brass to break up into fragments in response to an explosive force; and explosive material between the housing and the liner.

2. The shaped-charge assembly of claim 1, wherein the apex portion includes an opening.

3. The shaped-charge assembly of claim 1, wherein the shaped-charge assembly is in a perforation tool for downhole operations.

4. The shaped-charge assembly of claim 1, wherein the single liner is parabolic shaped.

5. The shaped-charge assembly of claim 1, wherein the apex portion is connected to the skirt portion.

6. The shaped-charge assembly of claim 1, wherein the skirt portion is connected to the housing.

7. A shaped-charge liner for a downhole shaped-charge assembly, the shaped-charge liner comprising:

an apex portion constructed from copper to create a large perforation hole; and a skirt portion constructed from brass to break up into fragments in response to an explosive force.

8. The shaped-charge liner of claim 7, wherein the downhole shaped-charge assembly is in a perforation tool for downhole operations.

9. The shaped-charge liner of claim 7, wherein the apex portion is connected to the skirt portion.

10. The shaped-charge liner of claim 7, wherein the skirt portion is connected to a housing of the downhole shaped-charge assembly.

11. A perforation tool, comprising:

a shaped-charge assembly that includes a single liner, the single liner including:

an apex portion constructed from copper to create a large perforation hole; and a skirt portion constructed from brass to break up into fragments in response to an explosive force.

12. The perforation tool of claim 11, wherein the single liner is parabolic shaped.

13. The perforation tool of claim 11, wherein the apex portion is connected to the skirt portion.

14. The perforation tool of claim 11, wherein the skirt portion is connected to a housing of the shaped-charge assembly.

* * * * *